US006391215B1

(12) United States Patent
Smith et al.

(10) Patent No.: US 6,391,215 B1
(45) Date of Patent: May 21, 2002

(54) DIAMOND MARKING

(75) Inventors: James Gordon Charters Smith, Buckinghamshire; Andrew David Garry Stewart, Berkshire, both of (GB)

(73) Assignee: Gersan Establishment, Liechtenstein ( * ) Notice: Subject to any disclaimer, the term of this patent is extended or adjusted under 35 U.S.C. 154(b) by 0 days.

(21) Appl. No.: 09/424,286

(22) PCT Filed: May 22, 1998

(86) PCT No.: PCT/GB98/01497

§ 371 Date: Mar. 6, 2000

§ 102(e) Date: Mar. 6, 2000

(87) PCT Pub. No.: WO98/52774

PCT Pub. Date: Nov. 26, 1998

(30) Foreign Application Priority Data

May 23, 1997 (GB) ..... 9710738
Dec. 24, 1997 (GB) ..... 9727365

(51) Int. Cl.[7] ..... B44C 1/22

(52) U.S. Cl. ..... 216/28; 216/66; 216/94; 250/423; 204/192.1; 204/298.36; 63/32

(58) Field of Search ..... 216/28, 66, 94; 250/423; 204/192.1, 298.36; 63/32

(56) References Cited

U.S. PATENT DOCUMENTS

| | | | | |
|---|---|---|---|---|
| 4,085,330 A | | 4/1978 | Wolfe | |
| 4,117,301 A | | 9/1978 | Goel et al. | 219/121 |
| 4,184,079 A | | 1/1980 | Hudson et al. | 250/492 |
| 4,200,506 A | | 4/1980 | Dreschhoff et al. | 204/157 |
| 4,219,199 A | | 8/1980 | Okuda | 204/38 |
| 4,392,476 A | | 7/1983 | Gresser et al. | 125/30 |
| 4,425,769 A | | 1/1984 | Hakoune | 63/32 |
| 4,450,041 A | | 5/1984 | Akluffi | 156/628 |
| 4,457,803 A | | 7/1984 | Takigawa | 156/626 |
| 4,467,172 A | | 8/1984 | Ehrenwald et al. | 219/121 |
| 4,639,301 A | | 1/1987 | Doherty et al. | 204/192 |
| 4,698,129 A | | 10/1987 | Puretz et al. | 156/643 |
| 4,764,432 A | | 8/1988 | Kalbitzer | 428/446 |
| 4,833,328 A | | 5/1989 | Prins et al. | 250/370 |
| 4,967,088 A | | 10/1990 | Stengl et al. | |
| 4,999,083 A | | 3/1991 | Watanabe | 156/628 |
| 5,149,938 A | | 9/1992 | Winston et al. | 219/121 |
| 5,178,645 A | | 1/1993 | Nakamura et al. | 51/293 |
| 5,234,537 A | * | 8/1993 | Nagano et al. | 156/643 |
| 5,334,283 A | | 8/1994 | Parikh et al. | 156/654 |
| 5,410,125 A | | 4/1995 | Winston et al. | 219/121 |
| 5,560,241 A | | 10/1996 | Satoh et al. | 72/467 |
| 5,573,684 A | | 11/1996 | Winston et al. | 219/121 |
| 5,702,586 A | | 12/1997 | Pehrsson et al. | 205/640 |
| 5,721,687 A | | 2/1998 | Lamartine et al. | 364/474 |
| 5,773,116 A | | 6/1998 | Lamartine et al. | 428/64 |
| 5,908,314 A | | 6/1999 | Lin et al. | |

FOREIGN PATENT DOCUMENTS

| | | | |
|---|---|---|---|
| EP | 499439 | 10/1991 | |
| EP | 799680 | 10/1997 | |
| GB | 1588445 | 4/1981 | |
| GB | 2244958 | 12/1991 | |
| JP | 55162243 | * 12/1980 | H01L/21/86 |
| WO | 96/32741 | 10/1996 | |
| WO | 97/03846 | 2/1997 | |
| WO | 97/09470 | 3/1997 | |
| WO | 97/25177 | 7/1997 | |
| WO | 97/44753 | 11/1997 | |
| WO | 97/48128 | 12/1997 | |

OTHER PUBLICATIONS

Erickson et al., Printing halftone photographic images on diamond by focused silicon ion implantation, pp. 2358–2361, Journal Vac. Sci. Technology Nov./Dec. 1997.

Yamaguchi et al. paper, Characteristics of Silicon Removal by Fine Focused Gallium Ion Beam, Jan./Feb. 1985, pp. 71–74, Journal of Vacuum Science and Technology.

Mori and Yoshikawa paper, Micromachining of CVd diamond Films Using a Focused ion Beam, pp. 233–240, Diamond Films and Technology, vol. 6, No. 1, 1996.

E.G. Spencer and P.H. Schmidt, Ion Machining of Diamond, Jul. 1972,pp. 2956–2958, Journal of Applied Physics.

Braunstein et al. paper, Depth profile of antimony implanted into diamond, Sep. 1979, pp. 5731–5735, Journal of Applied Physics, 50(9).

* cited by examiner

*Primary Examiner*—Randy Gulakowski
*Assistant Examiner*—Michael Kornakov
(74) *Attorney, Agent, or Firm*—Cesari and McKenna, LLP

(57) ABSTRACT

An information mark invisible to the naked eye is applied to the polished facet of a diamond gemstone by coating the diamond gemstone surface with an electrically conductive layer so as to prevent the diamond becoming charged, forming the mark with a focused ion beam, and cleaning the diamond surface with a powerful oxidizing agent to reveal a mark having an appropriate depth, which does not detrimentally affect the clarity or color grade of the diamond.

75 Claims, No Drawings

DIAMOND MARKING

BACKGROUND OF THE INVENTION

The present invention relates to a method of marking a surface of a diamond or gemstone. The mark may be any mark, but the invention is particularly though not exclusively directed to applying an information mark to the diamond or gemstone. The diamond may be for instance an industrial diamond such as a wire-drawing die-or diamond optical component, though the invention is of particular interest in marking gemstone diamonds, for instance for applying a mark which is invisible to the naked eye or invisible to the eye using a ×10 loupe, when the mark can be applied to a polished facet of the gemstone without detracting from its clarity or color grade. When a loupe is used, the visibility is assessed under the internationally accepted conditions for clarity grading, i.e. using a 10× magnifying achromatic, aplanatic loupe under normal light, this being a white diffuse light, not a spot light. The marks can be used to uniquely identify the gemstone by a serial number or as a brand or quality mark. In general, the mark should be capable of being viewed under suitable magnification and viewing conditions, and, if applied to a gemstone, should not detract from the value or appearance of the stone and should preferably not exhibit blackening.

There is a detailed description of the nature of the marks that can be applied in WO 97/03846, which is incorporated herein by reference and in which the marks are applied by irradiating a diamond gemstone with ultraviolet laser radiation using a projection mask. U.S. Pat. No. 4,425,769 describes providing an identifying mark on a diamond or other gemstone by applying a photoresist to the surface, forming a contact mask by a photographic method, and etching the gemstone through the mark by cathode bombardment with an ionised gas to provide sputter etching. Sputter etching gives poor control of the depth of the mark and low resolution.

THE INVENTION

According to a first aspect of the present invention, the surface of a diamond or gemstone is marked with a focused ion beam, the mark being invisible to the naked eye. The invention extends to a diamond or gemstone which has been marked by the method of the invention, and to apparatus for carrying out the method.

The marking can be carried out by direct writing on the diamond or gemstone surface with a focused ion beam. Typically Gallium ions are used, but a beam of other suitable ions may alternatively be used. By limiting the dose, sputtering of carbon atoms can be substantially avoided, sputtering causing direct material removal; this enables a mark to be applied with a controlled depth and good resolution. By limiting the dose, and providing there is sufficient dose, the incident ions cause disordering of the crystal lattice. In the case of diamond, this converts the diamond to a graphite-like or other non-diamond structure that can then be cleaned, e.g. using an acid or potassium nitrate dissolved in acid, to leave a shallow mark say not less than 10 nm deep and/or not more than 70 nm deep, more preferably say not less than 20 nm deep and/or not more than about 50 nm deep, typically about 30 nm deep, with no evidence of blackening. Plasma etching may be used as an alternative to acid cleaning.

However, in a preferred embodiment, the disordered layer produced on the diamond or gemstone by the ion beam is removed by means of a powerful oxidizing agent, such as molten potassium nitrate. This method allows a mark to be produced at a lower dose and therefore in less time at a given beam current. Alternatively, a lower beam current, giving a smaller spot size may be used to produce marks with higher resolution features, such as diffraction gratings.

The depth of the lattice disordering is determined by the range of the ions. For 50 keV Gallium, this range is about 30 nm. The minimum dose may be as low as $10^{13}/cm^2$, but is preferably about $10^{14}/cm^2$ to $10^{15}/cm^2$. However, good marks can be applied with a fairly modest dose, the preferred maximum dose being about $10^{16}/cm^2$ or even up to about $10^{17}/cm^2$. However, the dose depends upon the ions being used and their energy (as measured in keV). The ion beam dose is a total number of incident ions per unit area at the sample surface, during the marking. The beam current may be about 1 nA, and the beam energy not less than about 10 keV or about 30 keV and/or not greater than about 100 keV or about 50 keV.

It has been found that if depth of mark is plotted against ion beam dose for a series of different beam energies, there is an increase of depth of mark with increasing beam energy. Characteristics of the mark may be optimised by selecting from the dose/energy combinations which will result in the desired depth of mark.

The region to be marked and/or the surrounding area may be coated with an electrically-conducting layer, for instance gold, prior to forming the mark, so that an electrical connection can be provided before marking with the ion beam, to prevent charging. The thickness of the gold, or other, coating alters the variation of depth of mark with beam energy and dose, and may thus be chosen to optimise the mark produced.

Other suitable methods to reduce charging may be used. One method is to irradiate the region to be marked with a low energy ion beam, e.g. about 3 to about 10 keV, prior to forming the mark, to modify the diamond surface to cause it to become electrically conductive, the electrical connection being made to that region. In a preferred embodiment, the ion beam used for marking may be used in conjunction with a charge neutralising device, such as an electron flood gun, such as that described in U.S. patent specification number U.S. Pat. No. 4,639,301, to prevent charging of the diamond surface.

In accordance with a second aspect of the present invention, there is provided a method of marking the surface of a diamond or gemstone, comprising the steps of irradiating at least a portion of said diamond or gemstone to form a damaged or crystal lattice disordered layer thereon, and removing said disordered layer using an oxidizing agent.

A further advantage of the second aspect of the present invention over acid-cleaning is that no acid fumes are produced and also that spent acid does not have to be disposed of, thereby improving the safety of the process as well as offering environmental and economic benefits.

The oxidizing agent is preferably molten potassium nitrate. The diamond or gemstone is preferably covered with potassium nitrate and heated to a temperature of around 380–550 Centigrade for a period of between a few minutes and several hours, preferably approximately one hour.

However, other suitable powerful oxidizing agents include molten compounds such as alkali metal salts. Suitable compounds may be in the form Xn Ym where the group X may be $Li^+$, $Na^+$, $K^+$, $Rb^+$, $Cs^+$, or other cation, and the group Y may be $OH^-$, $NO_3^-$, $O_2^{2-}$, $O^{2-}$, $CO_3^{2-}$, or other anion; the integers n and m being used to maintain charge balance. Mixtures of compounds may be used. Air or other oxygen-containing compounds may also be present.

The use of such oxidizing agents to remove a disordered layer allows a mark of a desired depth to be produced using a relatively low dose of ions.

In a preferred embodiment, the diamond or gemstone is irradiated with an ion beam as in the first aspect of the present invention, and most preferably a Gallium ion beam. The preferred embodiment of the method of the second aspect resulting in a remarkably efficient process, with each incident Gallium ion ultimately resulting in the removal of approximately 2,700 carbon atoms. In most materials other than diamond, this figure would be around 1–10.

It is this property of diamond that allows the relatively large structures such as alphanumeric characters covering an area of 0.43 mm by 0.16 mm to be machined in a reasonably economic time of about 10 seconds.

The method of the present invention may also be used to mark the surface of a synthetic gemstone, such as the silicon carbide gemstones described in WO 97/09470.

EXAMPLE

A diamond gemstone is mounted in a suitable holder and a facet is coated with a layer of gold. The sample is placed in a vacuum chamber equipped with a focused ion beam source such as supplied by FEI or Micrion, the holder making an electrical connection to the gold layer to prevent the diamond becoming charged. Using a focused beam with a raster scan or similar to scan the beam for instance with electrostatic deflection (as an alternative, the diamond may be moved, but this is less practical), a mark is written on the diamond facet with ions to a dose of $10^{15}$ to $10^{16}/cm^2$, the ion source being Gallium, the beam current 1 nA and the beam energy 30 to 50 keV. The sample is removed from the vacuum chamber and acid cleaned to remove the disordered layer and the gold layer. There is a shallow mark typically about 30 nm deep, with no evidence of blackening.

The present invention has been described above purely by way of example, and modifications can be made within the spirit of the invention, which extends to the equivalents of the features described. The invention also consists in any individual features described or implicit herein or shown or implicit in the drawings or any combination of any such features or any generalisation of any such features or combination.

What is claimed is:

1. A method of forming on a polished facet of a diamond or silicon carbide gemstone an information mark which is invisible to the eye using a ×10 loupe, comprising:

coating at least a portion of said facet with an electrically-conducting layer;

forming the mark in said facet portion with a focused ion beam while substantially avoiding sputtering by moving the beam relative to the gemstone, the beam energy being from about 10 to about 100 keV, a dose of not less than about $10^{13}/cm^2$ and of not more than about $10^{17}/cm^2$ being applied, whereby the beam penetrates the electrically-conducting layer and forms from material of the diamond or gemstone a disordered layer in said facet portion; and removing said disordered layer by substantially covering the disordered layer with molten potassium nitrate, thereby forming a mark whose depth is from about 10 to about 70 nm and which comprises at least one line the ratio of the width to depth of which is greater than about 20:1.

2. A method of forming in the surface of a gemstone an information mark which is invisible to the naked eye and comprises at least one line having a width and a depth, the ratio of which is greater than about 20:1, by removal of material of said gemstone, comprising using a focused ion beam while substantially avoiding sputtering.

3. A method of forming in the surface of a diamond an information mark which is invisible to the naked eye and comprises at least one line having a width and a depth, the ratio of which is greater than about 20:1, by removal of material of said diamond, comprising using a focused ion beam while substantially avoiding sputtering.

4. The method of claim 2, wherein the gemstone is a silicon carbide gemstone.

5. A method of marking the surface of a gemstone, comprising the steps of irradiating with an ion beam at least a portion of said gemstone to form a mark, comprising a disordered layer therein from material of the gemstone, and removing said disordered layer using an oxidizing agent thereby forming a mark.

6. The method of claim 5, wherein the gemstone is a silicon carbide gemstone.

7. A method of marking the surface of a diamond, comprising the steps of irradiating with an ion beam at least a portion of the diamond to form a mark, comprising a disordered layer therein from material of the diamond, and removing said disordered layer using an oxidizing agent thereby forming a mark.

8. The method of claim 7, wherein the diamond is irradiated using a focused ion beam.

9. The method of claim 7, wherein the diamond is irradiated using a focused ion beam whilst substantially avoiding sputtering.

10. The method of claim 2, wherein the surface of the diamond is irradiated by means of said focused ion beam to form a disordered layer thereon, and said disordered layer is removed using an oxidizing agent.

11. The method of claim 7, wherein the oxidizing agent is at least one compound in the form XnYm where the group X is a cation, and the group Y is an oxygen-providing anion; the integers n and m being used to maintain charge balance.

12. The method of claim 7, wherein the oxidizing agent is potassium nitrate.

13. A method of marking the surface of a diamond, comprising forming an information mark with a focused ion beam while substantially avoiding sputtering, the mark being invisible to the naked eye, and including the steps of irradiating at least a portion of the gemstone with an ion beam to form a disordered layer therein and removing said disordered layer by substantially covering the disordered layer with molten potassium nitrate.

14. A method of marking the surface of a diamond, comprising forming an information mark with a focused ion beam while substantially avoiding sputtering, the mark being invisible to the naked eye, and including the steps of irradiating the surface of the diamond by means of said focused ion beam to form a disordered layer therein, and removing said disordered layer using an acid.

15. The method of claim 14, wherein said disordered layer is removed using an oxidizing agent dissolved in acid.

16. The method of claim 15, wherein said disordered layer is removed using potassium nitrate dissolved in acid.

17. The method of claim 2, including coating said surface with an electrically-conductive layer prior to forming the mark.

18. The method of claim 1, wherein the electrically-conductive layer is gold.

19. The method of claim 2, wherein the region to be marked is irradiated with a low energy ion beam prior to forming the mark, to modify the diamond surface to cause it to become electrically conductive.

20. The method of claim 2, wherein the region to be marked is simultaneously irradiated using a charge neutralizing device.

21. The method of claim 2, wherein the mark is formed at an ion dose of not more than about $10^{17}/cm^2$.

22. The method of claim 21, wherein the mark is formed at an ion dose of not more than about $10^{16}/cm^2$.

23. The method of claim 21, wherein the mark is formed at an ion dose of not more than about $10^{15}/cm^2$.

24. The method of claim 21, wherein the mark is formed at an ion dose of not more than about $10^{14}/cm^2$.

25. The method of claim 21, wherein the mark is formed at an ion dose of not more than about $10^{13}/cm^2$.

26. The method of claim 2, wherein the depth of the mark is about 10 to 70 nm.

27. The method of claim 26, wherein the depth of the mark is about 20 to 50 nm.

28. The method of claim 26, wherein the depth of the mark is about 20 to 30 nm.

29. The method of claim 2, wherein the mark comprises characters whose height is about 50 microns.

30. The method of claim 2, wherein the mark comprises lines of a width of about 2 to 3 microns.

31. The method of claim 2, wherein the depth of the mark is not more than about 100 nm.

32. The method of claim 2, wherein the mark comprises lines the ratio of the width to depth of which is greater than about 20:1.

33. The method of claim 2, wherein the mark is an information mark.

34. The method of claim 2, wherein the mark is invisible to the eye using a ×10 loupe.

35. The method of claim 7, wherein the mark is invisible to the naked eye.

36. The method of claim 2, wherein the mark is applied to a polished facet of a gemstone or diamond.

37. A gemstone which has in a facet thereof a mark formed by the method of claim 2 by the removal of material of said gemstone, the mark being an information mark which is invisible to the naked eye and comprises at least one line having a width and a depth, the ratio of which is greater than 20:1.

38. The method of claim 1, wherein said dose is of not less than about $10^{15}/cm^2$.

39. The method of claim 2, wherein the focused ion beam is moved relative to the gemstone, thereby directly writing on the gemstone.

40. The method of claim 11, wherein the group X is selected from the group consisting of $Li^+$, $Na^+$, $K^+$, $Rb^+$ and $Cs^+$.

41. The method of claim 11, wherein Y is selected from the group consisting of $OH^-$, $NO^-_3$, $O_2^{2-}$, $O^{2-}$ and $CO_3^{2-}$.

42. The method of claim 40, wherein Y is selected from the group consisting of $OH^-$, $NO^-_3$, $O_2^{2-}$, $O^{2-}$ and $CO_3^{2-}$.

43. The method of claim 5, wherein the mark comprises at least one line the ratio of the width to depth of which is greater than about 20:1.

44. The method of claim 7, wherein the mark comprises at least one line the ratio of the width to depth of which is greater than about 20:1.

45. A diamond which has in a facet thereof a mark formed by the method of claim 3 by the removal of material of said diamond, the mark being an information mark which is invisible to the naked eye and comprises at least one line having a width and a depth, the width to depth ratio being greater than about 20:1.

46. The method of claim 9, wherein gallium ions are used for the focused ion beam and, after removing the disordered layer with the oxidizing agent, each incident gallium ion results in the removal of more than 1000 carbon atoms.

47. The method of claim 9, wherein gallium ions are used for the focused ion beam and, after removing the disordered layer with the oxidizing agent, each incident gallium ion results in the removal of close to 2700 carbon atoms.

48. The method of claim 1, wherein the diamond is a gemstone.

49. The method of claim 3, wherein the diamond is a gemstone.

50. The method of claim 7, wherein the diamond is a gemstone.

51. The method of claim 5, wherein the gemstone is irradiated whilst substantially avoiding sputtering using a focused ion beam.

52. The method of claim 5, wherein the mark is an information mark which is invisible to the naked eye and comprises at least one line having a width and a depth, the ratio of which is greater than about 20:1.

53. The method of claim 7, wherein the mark is an information mark which is invisible to the naked eye and comprises at least one line having a width and a depth, the ratio of which is greater than about 20:1.

54. The method of claim 3, wherein the mark is formed at an ion dose of not more than about $10^{17}/cm^2$.

55. The method of claim 5, wherein the mark is formed at an ion dose of not more than about $10^{17}/cm^2$.

56. The method of claim 7, wherein the mark is formed at an ion dose of not more than about $10^{17}/cm^2$.

57. The method of claim 3, wherein the depth of the mark is not more than about 100 nm.

58. The method of claim 5, wherein the depth of the mark is not more than about 100 nm.

59. The method of claim 7, wherein the depth of the mark is not more than about 100 nm.

60. A method of marking the surface of a diamond gemstone comprising forming in a polished facet of the gemstone an information mark which is invisible to the naked eye by irradiating the facet with a focused ion beam with an ion dose of not more than $10^{17}/cm^2$ in order to form a disordered layer in said facet corresponding to said mark and removing said disordered layer using an oxidizing agent.

61. The method of claim 60, wherein the depth of the mark is not more than about 100 nm.

62. The method of claim 60, wherein the mark comprises at least one line having a width and a depth, the ratio of which is greater than about 20:1.

63. The method of claims 31, wherein the mark is formed at an ion dose of not more than about $10^{17}/cm^2$.

64. The method of claim 7, wherein the mark is formed at an ion dose of not more than about $10^{16}/cm^2$.

65. The method of claim 7, wherein the mark is formed at an ion dose of not more than about $10^{15}/cm^2$.

66. The method of claim 7, wherein the mark is formed at an ion dose of not more than about $10^{14}/cm^2$.

67. The method of claim 7, wherein the mark is formed at an ion dose of not more than about $10^{13}/cm^2$.

68. The method of claim 7, wherein a depth of the mark is less than about 70 nm.

69. The method of claim 7, wherein a depth of the mark is less than about 50 nm.

70. The method of claim 7, wherein a depth of the mark is less than about 30 nm.

71. The method of claim 5, wherein the mark is formed at an ion dose of not more than about $10^{17}/cm^2$.

72. The method of claim 7, wherein the mark is formed at an ion dose of not more than about $10^{17}/cm^2$.

73. The method of claim 3, wherein the depth of the mark is not more than about 100 nm.

74. The method of claim 5, wherein a depth of the mark is not more than about 100 nm.

75. The method of claim 1, wherein the depth of the mark is not more than about 70 nm.

* * * * *